US012022939B2

(12) United States Patent
Leng

(10) Patent No.: US 12,022,939 B2
(45) Date of Patent: Jul. 2, 2024

(54) TABLE PANEL

(71) Applicant: New-Tec Integration (Xiamen) Co., Ltd., Xiamen (CN)

(72) Inventor: Luhao Leng, Xiamen (CN)

(73) Assignee: New-Tec Integration (Xiamen) Co., Ltd., Xiamen (CN)

( * ) Notice: Subject to any disclaimer, the term of this patent is extended or adjusted under 35 U.S.C. 154(b) by 599 days.

(21) Appl. No.: 17/188,206

(22) Filed: Mar. 1, 2021

(65) Prior Publication Data

US 2021/0177138 A1 Jun. 17, 2021

Related U.S. Application Data

(63) Continuation of application No. PCT/CN2019/103406, filed on Aug. 29, 2019.

(30) Foreign Application Priority Data

Aug. 30, 2018 (CN) ..... 201821415203.7

(51) Int. Cl.
*A47B 13/08* (2006.01)
*A47B 96/20* (2006.01)

(52) U.S. Cl.
CPC ..... *A47B 13/083* (2013.01); *A47B 96/201* (2013.01); *A47B 96/205* (2013.01)

(58) Field of Classification Search
None
See application file for complete search history.

(56) References Cited

U.S. PATENT DOCUMENTS

2003/0217676 A1* 11/2003 Strong ..... A47B 13/08 108/127
2014/0299026 A1* 10/2014 Peery ..... A47B 3/0912 108/91

(Continued)

FOREIGN PATENT DOCUMENTS

CN 102783815 A 11/2012
CN 205093820 U 3/2016

(Continued)

OTHER PUBLICATIONS

International Search Report and English Translation as cited in PCT/CN2019/103406 dated Dec. 5, 2019, 6 pages.

(Continued)

*Primary Examiner* — Elizabeth Collister
(74) *Attorney, Agent, or Firm* — Cooper Legal Group LLC

(57) ABSTRACT

The present disclosure discloses a table panel, which comprises a table panel comprises a support panel and a metal frame. A periphery of the support panel is disposed with a downward folding edge, and the metal frame is disposed on a bottom of the support panel and is disposed along the periphery of the support panel. An outer side surface of the metal frame abuts an inner side surface of the downward folding edge. A lower end of the outer side surface of the metal frame is disposed with a connecting piece extending downward, and a bottom of the connecting piece is outwardly folded from a bottom of the downward folding edge to define a pressing edge configured to be buckled to an outer side of the bottom of the downward folding edge. The pressing edge is secured to the downward folding edge by riveting.

6 Claims, 6 Drawing Sheets

(56) References Cited

U.S. PATENT DOCUMENTS

| | | | | |
|---|---|---|---|---|
| 2018/0064242 | A1 | 3/2018 | Tsai | |
| 2019/0021484 | A1 * | 1/2019 | Leng | A47B 96/205 |

FOREIGN PATENT DOCUMENTS

| | | | |
|---|---|---|---|
| CN | 209284479 | U | 8/2019 |
| EP | 3238566 | A1 | 11/2017 |
| EP | 3351144 | A1 | 7/2018 |
| WO | 2005110151 | A1 | 11/2005 |

OTHER PUBLICATIONS

Written Opinion as cited in PCT/CN2019/103406 dated Dec. 5, 2019, 4 pages.
Corresponding European Patent Application No. 19853806, Supplementary European Search Report dated Mar. 30, 2022.
Corresponding European Patent Application No. 19853806, Extended European Search Report dated Apr. 8, 2022.

* cited by examiner

TABLE PANEL

RELATED APPLICATIONS

This application a continuation application of International Patent Application PCT/CN2019/103406, filed on Aug. 29, 2019, which claims priority to Chinese patent application number 201821415203.7, filed Aug. 30, 2018. International Patent Application PCT/CN2019/103406 and Chinese patent application number 201821415203.7 are incorporated herein by reference.

FIELD OF THE DISCLOSURE

The present disclosure relates to a table panel, and in particular relates to a table panel having a combination of a top panel and a bottom panel.

BACKGROUND OF THE DISCLOSURE

Plastic table panels have the advantages of being light weight and low cost, especially plastic suction panels that comprise a top panel and a bottom panel. A thickness of a plastic suction panel is only about 1-2 mm. Therefore, the strength of the plastic suction panel comprising the top panel and the bottom panel is often weak. In order to enable the plastic suction panel to meet strength requirements when the plastic suction panel has a small thickness, it is conventional that a honeycomb structure is disposed on the plastic suction panel, a reinforcing bar is disposed under the table panel, or a metal frame is disposed around the table panel.

When the metal frame is disposed for reinforcing, since the thickness of the plastic suction panel is small, the side of the plastic suction panel is soft and easy to tilt up. Therefore, even in case that the plastic suction panel and the metal frame need to be bonded together by glue, so sides of the plastic suction panel cannot be nicely fit to sides of the metal frame.

In summary, the assembly of the plastic suction panel and the metal frame needs glue for bonding, and the production workshop needs to add a glue coating process. Therefore, the production cost is increased. In addition, the size of the table panel is large, and the glue coating process is manually performed, resulting in a heavy workload.

BRIEF SUMMARY OF THE DISCLOSURE

The present disclosure provides a table panel, which is convenient to assemble to solve deficiencies of the existing techniques and to improve deficiencies related to a plastic side edge of the existing combination table panel being difficult to be secured.

In order to solve the technical problems of the present disclosure, a technical solution of the present disclosure is as follows.

A table panel comprises a top panel, a bottom panel, and a metal frame. The bottom panel comprises a honeycomb structure, a periphery of the top panel is disposed with a downward folding edge, the metal frame is disposed on a bottom of the bottom panel and is disposed along a periphery of the bottom panel, an inner side surface of the downward folding edge of the top panel abuts the metal frame, a lower end of an outer side surface of the metal frame is disposed with a connecting piece extending downward, the connecting piece is outwardly folded from a bottom of the downward folding edge of the top panel to define a pressing edge configured to be buckled to an outer side of the bottom of the downward folding edge, and the pressing edge is secured to the downward folding edge by riveting.

In a preferred embodiment, the metal frame and the connecting piece are integrally formed by bending a metal sheet.

In a preferred embodiment, the top panel is bonded to the bottom panel, the bottom panel is disposed with a honeycomb structure, and the honeycomb structure is made by plastic suction.

In a preferred embodiment, an outer periphery of a top surface (i.e., the downward folding edge) of the top panel is disposed with a locking step retracting inward, and the locking step corresponds to the connecting piece. When two table panels are stacked up and down, the connecting piece of an upper table panel of the two table panels is disposed in the locking step of a lower table panel of the two table panels.

In a preferred embodiment, a height of the locking step corresponds to a height of the connecting piece. When the two table panels are stacked up and down, a bottom of the metal frame of the upper table panel abuts a top surface of the top panel of the lower table panel.

Compared with the existing techniques, the technical solution has the following advantages.

1. The lower end of the outer side of the metal frame is disposed with a connecting piece, and the bottom of the connecting piece is folded to form a pressing edge that buckles to the outer side of the bottom of the downward folding edge, so that the downward folding edge is fastened to the connecting piece by the pressing edge. The downward folding edge and the metal frame are firmly connected, thereby simplifying the assembly process of the table panel and making it easy for automated production.

2. The downward folding edge is disposed on the outer side of the metal frame and the connecting piece. Since the connecting piece is below the metal frame, the height of the downward folding edge needs to be greater than the height of the side of the metal frame. That is, the presence of the connecting piece increases the height of the downward folding edge and thus increases the thickness of the side of the table panel, which greatly increases a thickness effect of the table panel.

3. The outer edge of the top surface of the top panel is disposed with a locking step extending inward. When two tables are stacked up and down, the connecting piece of the upper table panel is disposed in the locking step of the lower table panel. The structure is more stable, and the height of the stacked table panels can be effectively reduced.

BRIEF DESCRIPTION OF THE DRAWINGS

The present disclosure will be further described below in combination with the accompanying drawings and embodiments.

DETAILED DESCRIPTION OF THE EMBODIMENTS

Figure 1:
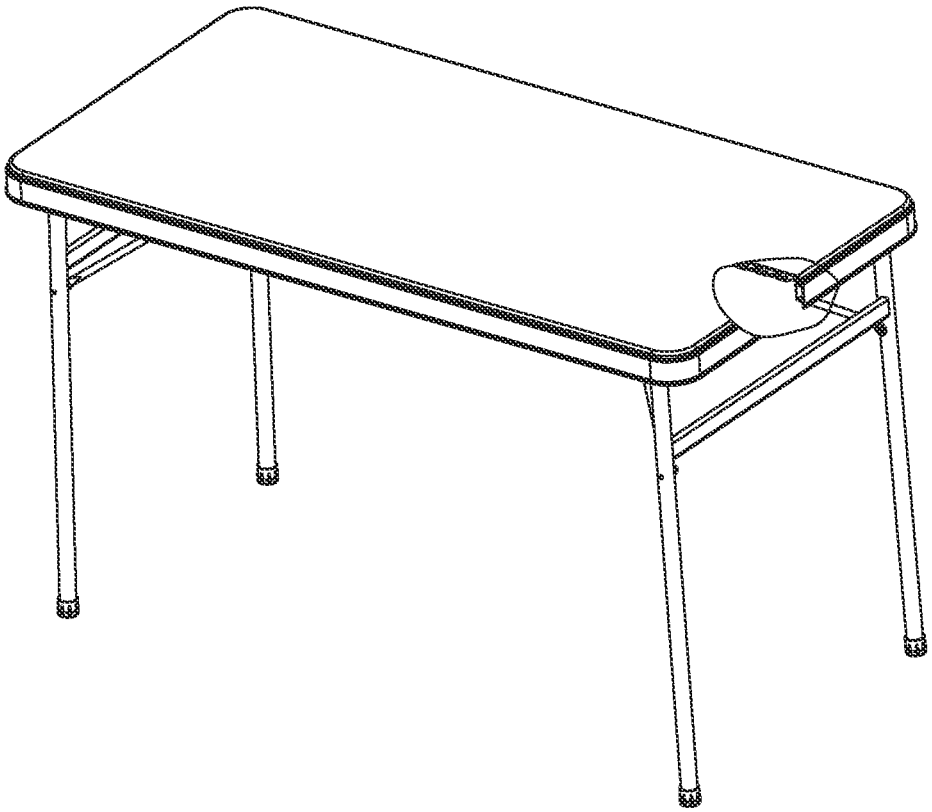
FIG. 1 illustrates an in-use view of a table panel of the present disclosure.
Figure 2:
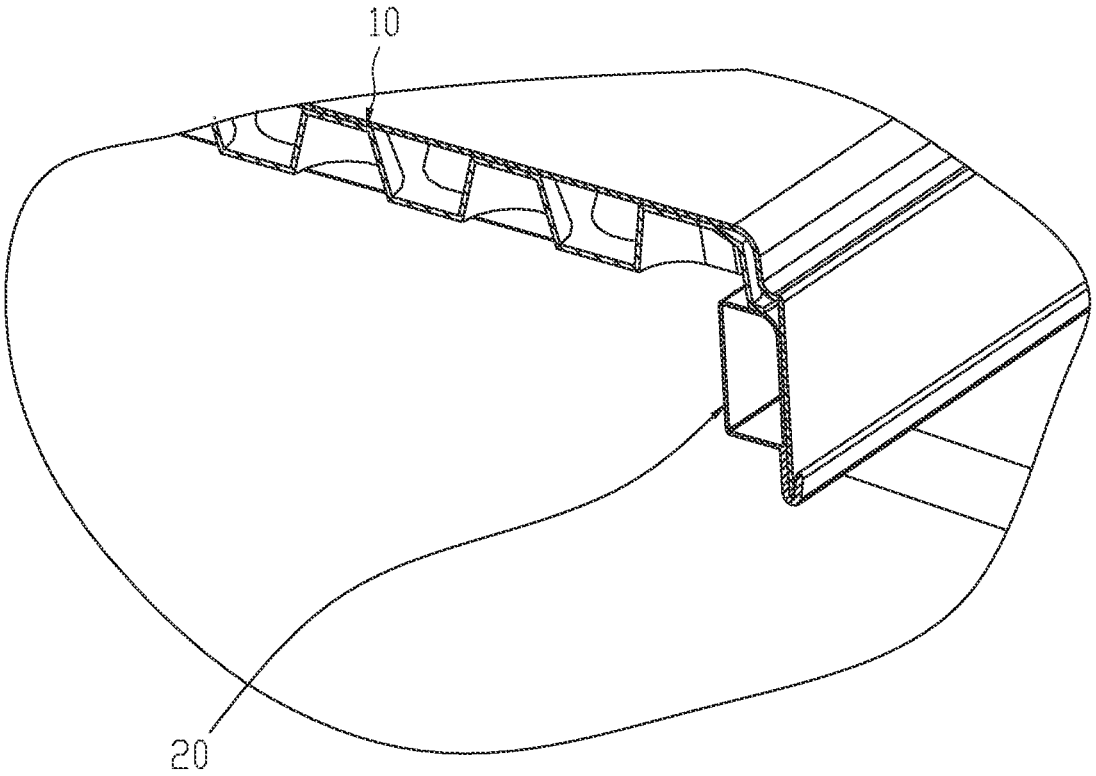
FIG. 2 illustrates an enlarged view of a closed circle of FIG. 1.
Figure 3:
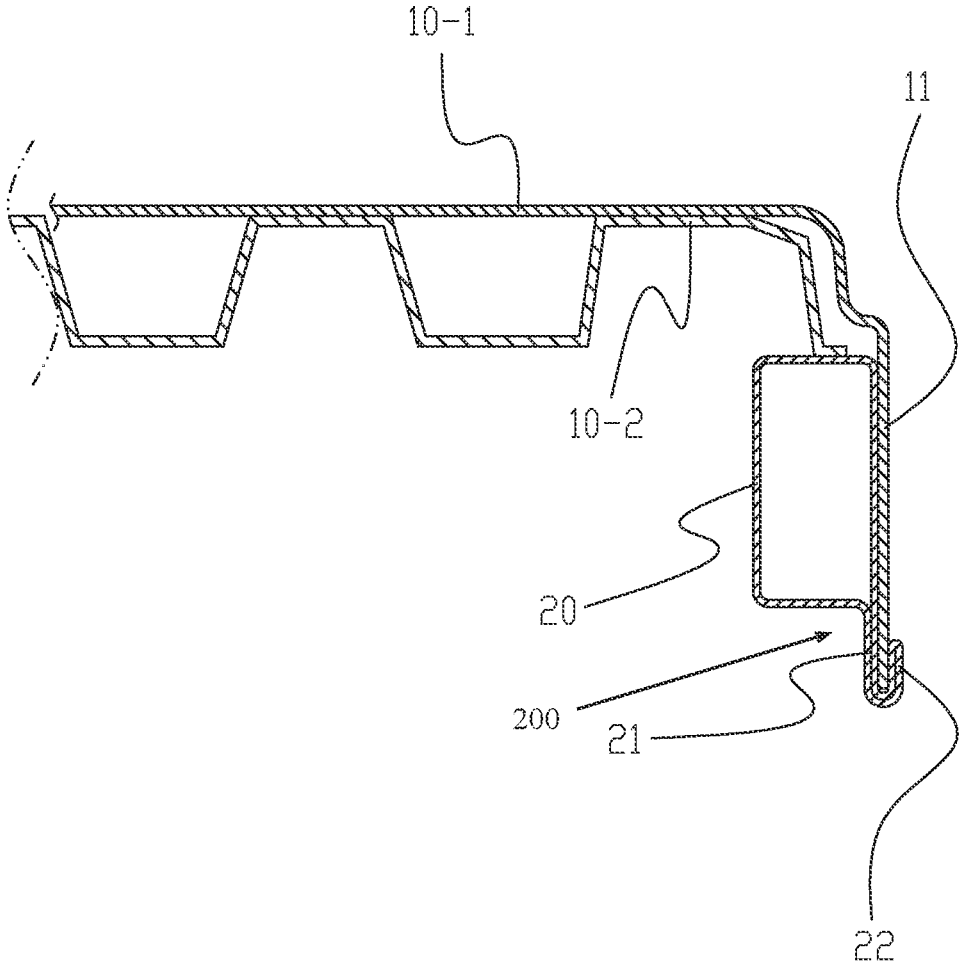
FIG. 3 illustrates a cross-sectional view of the table panel of the present disclosure.
Figure 4:
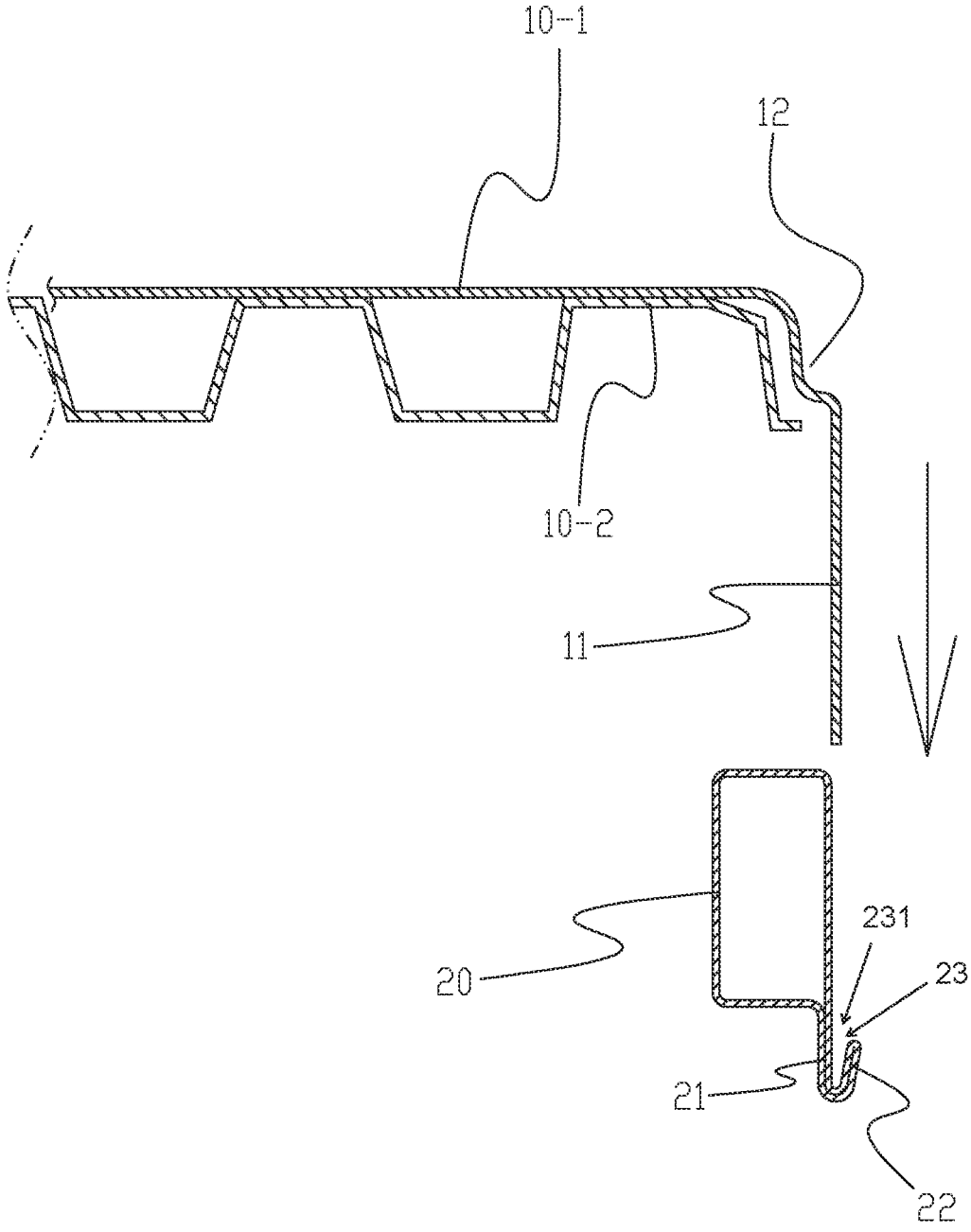
FIG. 4 illustrates a cross-sectional view of the table panel of the present disclosure before a support panel is assembled with a metal frame.
Figure 5:
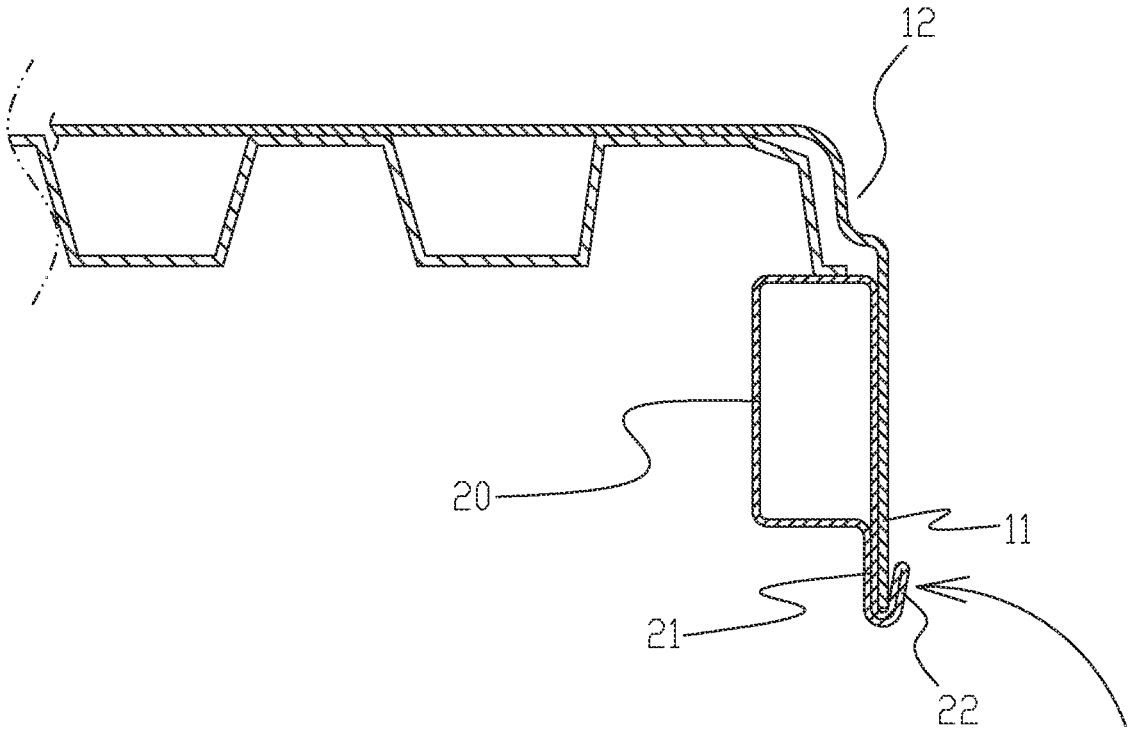
FIG. 5 illustrates a cross-sectional view of the table panel when a pressing edge does not abut a downward folding edge.

Referring to FIGS. 1-5, a table panel comprises a support panel 10 and a metal frame 20. A periphery of the support panel 10 is disposed with a downward folding edge 11, and the metal frame 20 is disposed on a bottom of the support panel 10 and is disposed along the periphery of the support panel 10. An outer side surface of the metal frame 20 abuts an inner side surface of the downward folding edge 11. A lower end of the outer side surface of the metal frame 20 is disposed with a connecting piece 21, a lower portion of the connecting piece 21 extends downward along the downward folding edge 11 is then outwardly folded from a bottom of the downward folding edge 11 to define a pressing edge 22 configured to be buckled to an outer side of the bottom of the downward folding edge 11, and the connecting piece 21 cooperates with the downward folding edge 11 to define a limiting portion 200. The pressing edge 22 is secured to the downward folding edge 11 by riveting. An upper portion of the connecting piece 21 and the pressing edge 22 define a hook structure 23 with an opening 231 facing upward, and the downward folding edge 11 is disposed in the hook structure 23.

The metal frame 20 is secured to the support panel 10 due to the pressing edge 22 being punched and riveted to the downward folding edge 11, and the structure is stable.

The metal frame 20 and the connecting piece 21 are integrally formed by bending a metal sheet, which have good deformability and is convenient for pressing, bending, punching, and riveting. It is obvious that the connecting piece 21 can also be formed separately from the metal frame 20 and then be welded to the metal frame 20. Therefore, the metal frame 20 can be made of a hollow steel pipe.

The support panel 10 comprises a top panel 10-1 and a bottom panel 10-2. A periphery of the bottom panel 10-2 abuts an upper surface of the metal frame 20, and a periphery of the top panel 10-1 is folded downward to define the downward folding edge 11. In some embodiments, the top panel 10-1 is bonded to the bottom panel 10-2, and the bottom panel 10-2 comprises a honeycomb structure. The top panel 10-1 and the bottom panel 10-2 are made of a plastic flat board having a thickness of about 1 mm. Traditional top panels are bonded to bottom panels at side surfaces since the plastic flat board is thin, is easily deformed, and periphery shaping is difficult due to a preset temperature during deforming and manufacturing. However, in the present disclosure, the lower end of the outer side surface of the metal frame 20 is disposed with the connecting piece 21 extending downward to enable the downward folding edge 11 to be disposed in an inner side of the pressing edge 22 of the connecting piece 21, and then the pressing edge 22 is punched and riveted to enable the pressing edge 22 to abut a lower edge of the downward folding edge 11. A side of the table panel is well protected due to a well shape provided by the connecting piece 21.

Figure 6:
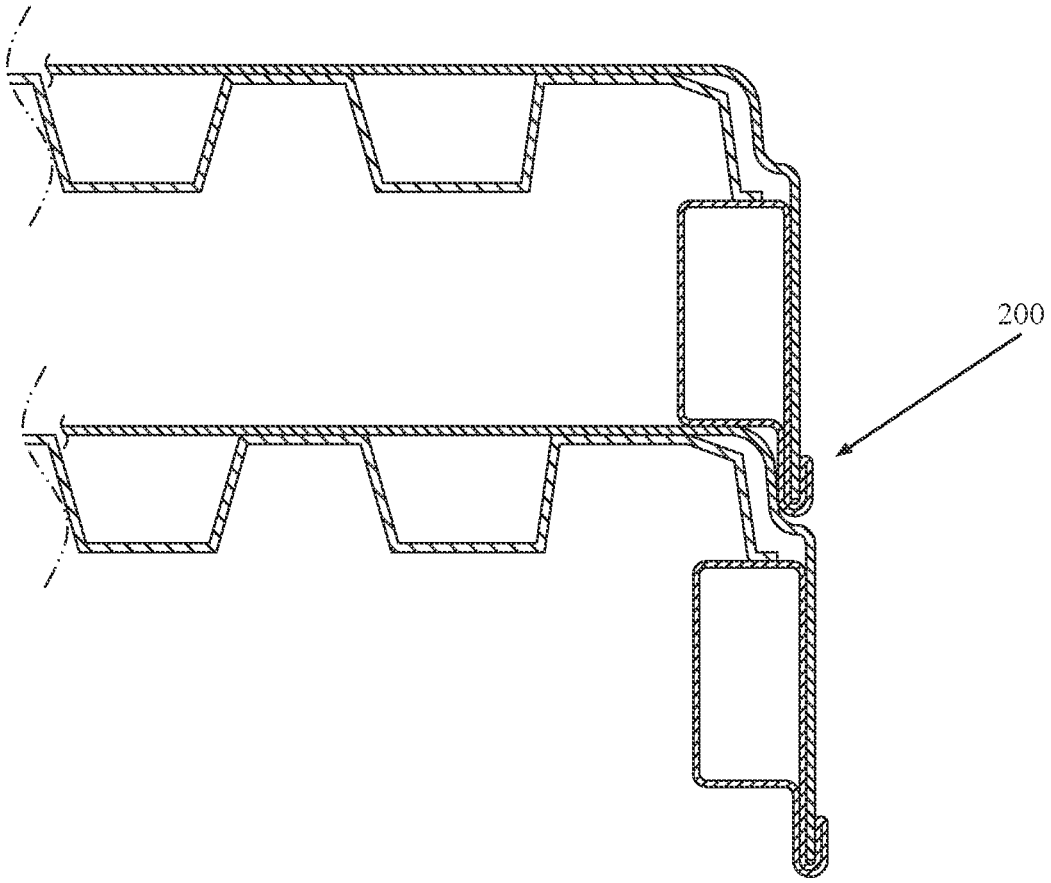
FIG. 6 illustrates a cross-sectional view of two of the table panels being vertically stacked.

An outer edge of a top surface (i.e., the downward folding edge 11) of the top panel 10-1 is disposed with a locking step 12 retracting inward, and the locking step 12 corresponds to the connecting piece 21. When two table panels are stacked up and down (i.e., in a vertical direction), referring to FIGS. 5-6, the locking step 12 of a lower table panel is limited by the limiting portion 200 of an upper table panel. In some embodiments, a height of the locking step 12 corresponds to a height of the connecting piece 21. When the two table panels are stacked up and down, a bottom of the metal frame 20 of the upper table panel abuts the top surface of the top panel 10-1 of the lower table panel.

An outer side surface and an outer side of the bottom of the metal frame 20 synchronously extend downward to cooperatively define the connecting piece 21, and the metal frame 20 and the connecting piece 21 define a closed shape.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A table panel, comprising:
a top panel,
a bottom panel, and
a metal frame, wherein:
the bottom panel comprises a honeycomb structure,
a periphery of the top panel is disposed with a downward folding edge,
the metal frame is fixedly disposed on a bottom of the bottom panel and is disposed along a periphery of the bottom panel,
an inner side surface of the downward folding edge of the top panel abuts the metal frame,
a lower end of an outer side surface of the metal frame is disposed with a connecting piece,
the connecting piece extends downward along the downward folding edge and is then outwardly folded from a bottom of the downward folding edge of the top panel to define a pressing edge configured to be buckled to an outer side of the bottom of the downward folding edge,
the connecting piece cooperates with the downward folding edge to define a limiting portion,
the pressing edge is secured to the downward folding edge by riveting,
the downward folding edge of the top panel is disposed with a locking step retracting inward,
the locking step corresponds to the connecting piece, and
when two table panels are stacked up and down, the locking step of a lower table panel of the two table panels is limited by the limiting portion of an upper table panel of the two table panels.

2. The table panel according to claim 1, wherein the metal frame and the connecting piece are integrally formed by bending a metal sheet.

3. The table panel according to claim 1, wherein:
a height of the locking step corresponds to a height of the connecting piece, and
when the two table panels are stacked up and down, a bottom of the metal frame of the upper table panel abuts a top surface of the top panel of the lower table panel.

4. The table panel according to claim 1, wherein:
the top panel is bonded to the bottom panel, and
the honeycomb structure is made by plastic suction.

5. The table panel according to claim 1, wherein:
an outer side surface and an outer side of a bottom of the metal frame synchronously extend downward to cooperatively define the connecting piece, and
the metal frame and the connecting piece define a closed shape.

6. A table panel, comprising:

a top panel, a bottom panel, and a metal frame, wherein:

the bottom panel comprises a honeycomb structure, a periphery of the top panel is disposed with a downward folding edge, the metal frame is disposed on a bottom of the bottom panel and is disposed along a periphery of the bottom panel, an inner side surface of the downward folding edge of the top panel abuts the metal frame, a lower end of an outer side surface of the metal frame is disposed with a connecting piece, the connecting piece extends downward along the downward folding edge and is then outwardly folded from a bottom of the downward folding edge of the top panel to define a pressing edge configured to be buckled to an outer side of the bottom of the downward folding edge, the connecting piece cooperates with the downward folding edge to define a limiting portion, the metal frame and the connecting piece are integrally formed by bending a metal sheet, the downward folding edge of the top panel is disposed with a locking step retracting inward, the locking step corresponds to the connecting piece, and when two table panels are stacked up and down, the locking step of a lower table panel of the two table panels is limited by the limiting portion of an upper table panel of the two table panels.

* * * * *